US005134737A

United States Patent [19]

Wyman

[11] Patent Number: 5,134,737

[45] Date of Patent: Aug. 4, 1992

[54] PATIENT BED SYSTEM

[75] Inventor: David L. Wyman, Grand Rapids, Mich.

[73] Assignee: Freedom Corporation, Grand Rapids, Mich.

[21] Appl. No.: 520,283

[22] Filed: May 7, 1990

[51] Int. Cl.[5] ..... A61G 7/00

[52] U.S. Cl. ..... 5/600; 5/604; 5/620; 5/81.1; 5/185

[58] Field of Search ..... 5/60, 81 R, 90, 181, 5/185; 297/DIG. 4; 4/480

[56] References Cited

U.S. PATENT DOCUMENTS

| | | | |
|---|---|---|---|
| 29,038 | 7/1860 | Keene | 5/60 |
| 106,343 | 8/1870 | Eastes . | |
| 1,105,487 | 7/1914 | Cassell | 5/185 |
| 1,787,380 | 12/1930 | Ipliojian . | |
| 2,318,240 | 5/1943 | Mas | 5/90 |
| 2,374,488 | 4/1945 | Knox | 5/60 |
| 2,607,929 | 8/1952 | Balluff | 5/66 |
| 2,869,614 | 1/1959 | Wamsley | 155/30 |
| 3,138,805 | 6/1964 | Piazza | 5/60 |
| 3,807,520 | 4/1974 | Chisholm | 180/6.5 |
| 3,959,833 | 6/1976 | Burke | 5/90 |
| 4,183,109 | 1/1980 | Howell | 5/60 |
| 4,240,169 | 12/1980 | Roos | 5/60 |
| 4,334,330 | 6/1982 | Marshall | 5/90 X |

FOREIGN PATENT DOCUMENTS

| | | | |
|---|---|---|---|
| 479379 | 8/1927 | Fed. Rep. of Germany . | |
| 921562 | 4/1982 | U.S.S.R. . | |
| 363730 | 12/1931 | United Kingdom | 5/185 |

*Primary Examiner*—Michael F. Trettel

*Attorney, Agent, or Firm*—Price, Heneveld, Cooper, DeWitt & Litton

[57] ABSTRACT

An extension assembly for converting an existing bed or the like to a patient care bed. The extension assembly includes a mattress and extension platform supported by legs on one side and by an existing bed on the other side. The extension further includes a cutaway located approximately midway along the outside edge of the extension platform and in the mattress to allow for patient care and to facilitate patient ingress into and egress out of bed without the necessity of lifting. The cutaway is designed to mate with and is normally filled by accessories such as a wheeled carriage or a flat insert.

21 Claims, 5 Drawing Sheets

PATIENT BED SYSTEM

This invention relates primarily to invalid care beds, and more specifically to an extension assembly for converting an existing bed into an invalid care bed, including a cutaway portion for patient care and a wheeled carriage for patient transport.

BACKGROUND OF THE INVENTION

In invalid care beds it is common practice to design beds with features specifically adapted for invalid care. Such features include beds which fold, tilt, move, and adjust in various manners to facilitate patient care and comfort. Various accessories have also been designed to cooperate with invalid beds such as stretchers, wheelchairs, eating trays, mechanical lifts and transfer boards. These invalid beds and accessories, however, tend to be a separate class of furnishings distinct from typical home furniture. They also lack the aesthetics and psychological appeal of typical home furnishings. Further, they are intended for invalid use and are often costly to manufacture in view of the increased complexity and limited market.

SUMMARY OF THE INVENTION

The present invention is directed to an extension assembly which converts an existing bed or the like into a patient care bed. The extension assembly is comprised of an extension platform and a mattress. The extension platform is operably connected to an existing bed frame or the like, and includes legs for supporting the extension platform. The mattress is preferably shaped to cover the extension platform and existing bed frame when the two are joined. Both the extension platform and the mattress have a cutaway which opens along the outside edge to facilitate patient care and entry/egress to the bed. Thus, an existing piece of home furniture can be easily and economically converted into a patient care bed and still retain the appearance of home furniture, rather than that of hospital furniture.

The extension assembly can include components which cooperate with the extension platform and mattress to further enhance its use. The components include a wheeled carriage, extension insert, and associated cushions. Both the wheeled carriage and the extension insert mate with the extension platform and mattress cutaway, and employ the same mattress insert to form a flush uniform mattress surface. By positioning the wheeled carriage in the cutaway with its back and arms removed, the patient can move from bed to chair without having to be lifted, simply by lying over the chair, sitting up and swinging his or her legs over the side of the bed extension assembly at the wheeled carriage. The patient can be returned without lifting by reversing this process. The legs and back are reassembled to the chair and the patient can be transported with minimal effort. The wheeled carriage allows patient transport with minimal effort. The extension insert also can double as a dining tray.

These and other advantages and features of the invention will be further understood and appreciated by those skilled in the art upon review of the following specification, claims, and appended drawings.

FIG. is an isometric view of the mattress and extension frame joined to a bed with a wheeled carriage fitted into the extension frame but having the wheeled carriage back rest and arm rests removed.

Figure 4:
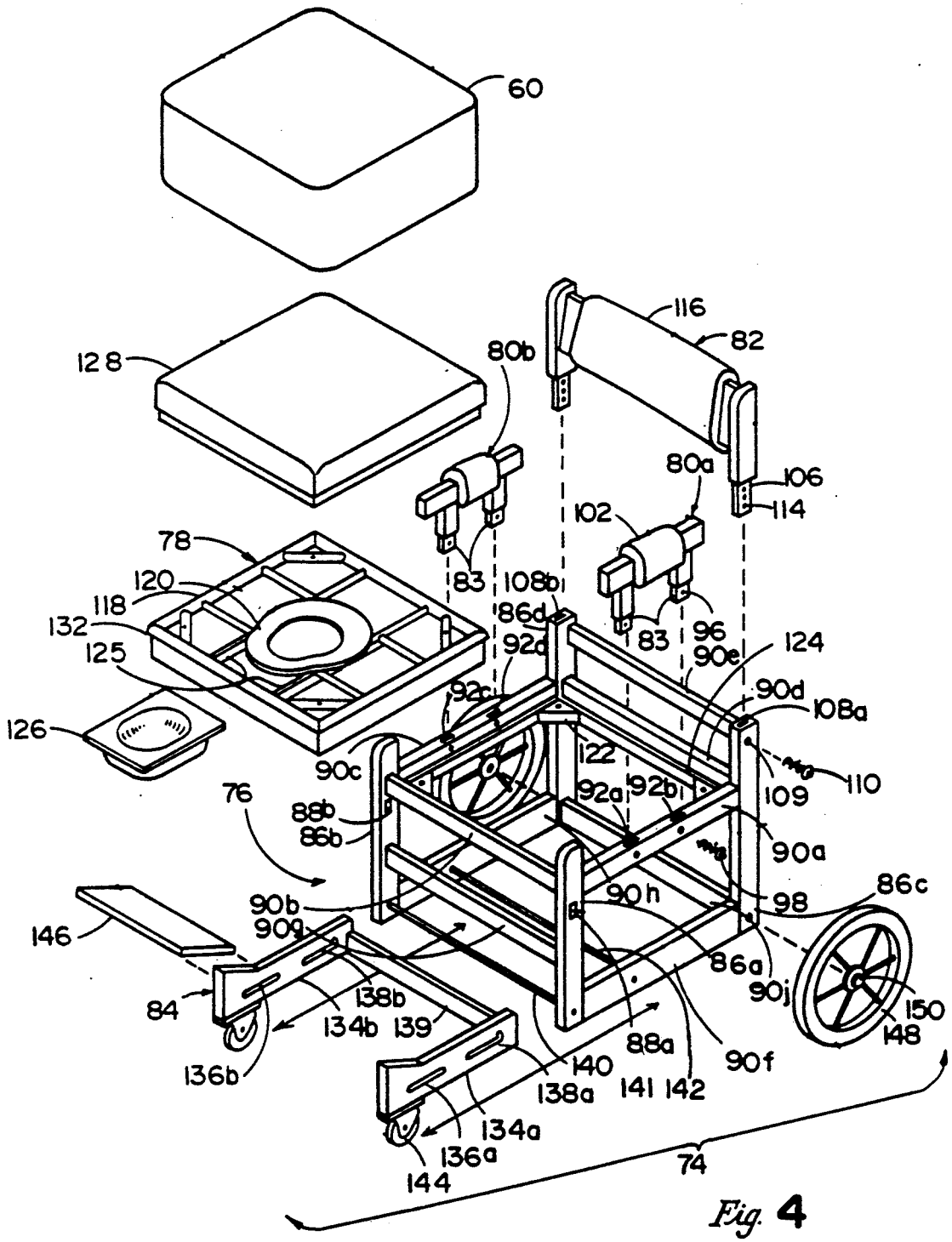

FIG. 4 is an exploded isometric view of the wheeled carriage.

Figure 5:
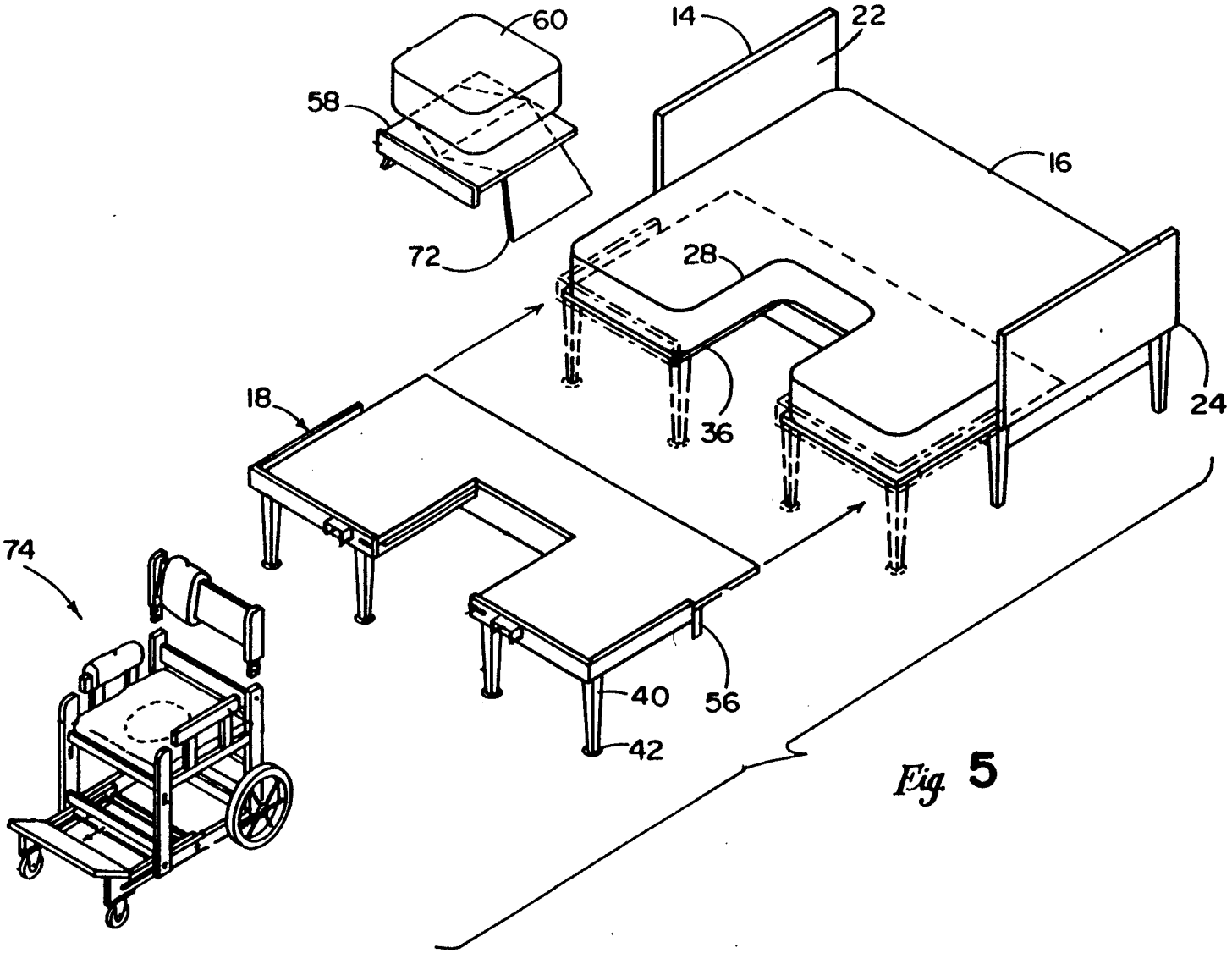

FIG. 5 is a partially exploded isometric view showing various extension assembly components and their corresponding relationship with an existing bed frame.

DETAILED DESCRIPTION OF THE PREFERRED EMBODIMENT

Figure 1:
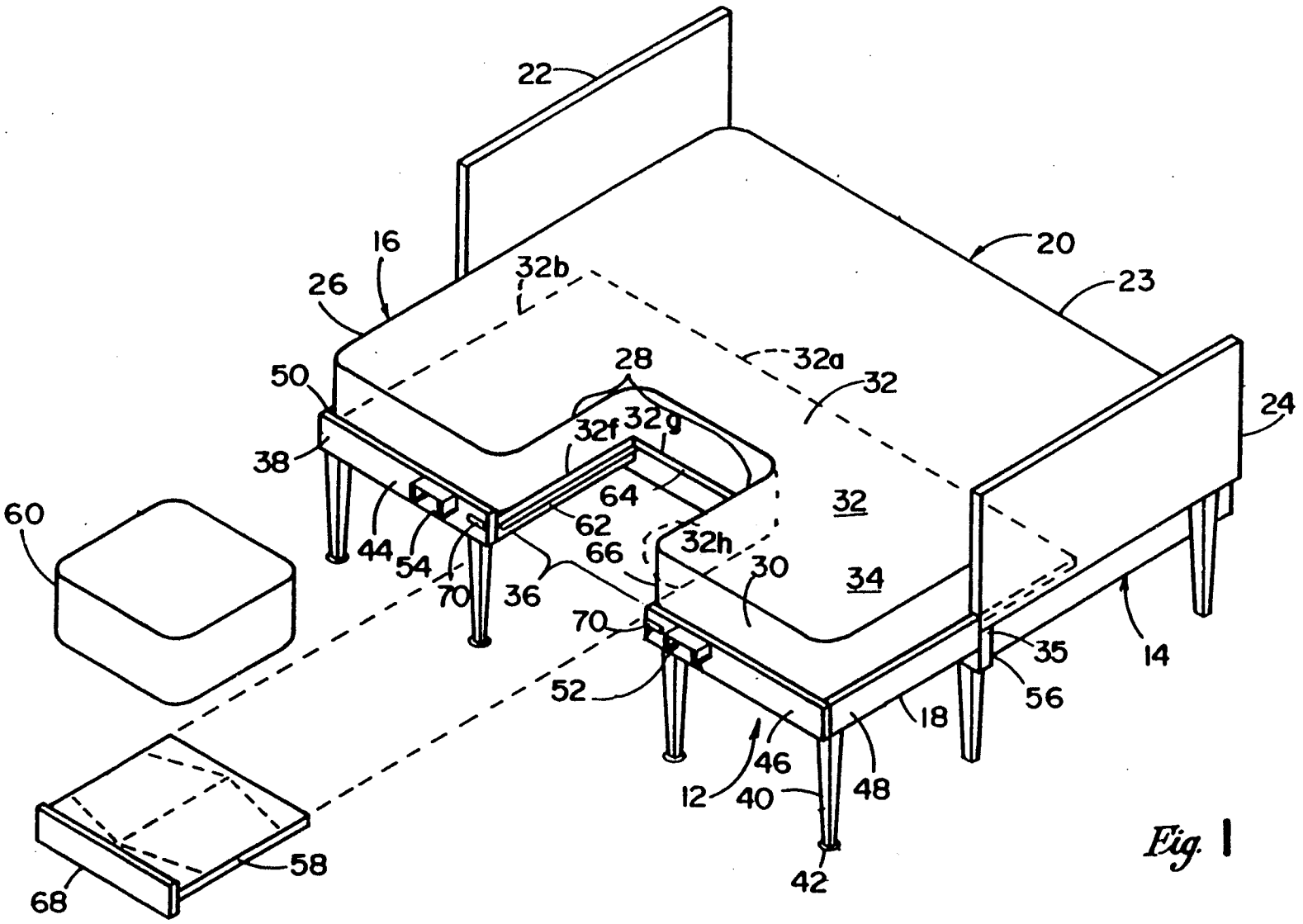
FIG. 1 is a partially exploded isometric view showing the components of the invention including a mattress and extension frame mounted on existing furniture with the extension insert and the extension insert cushion pulled away.
Figure 2:
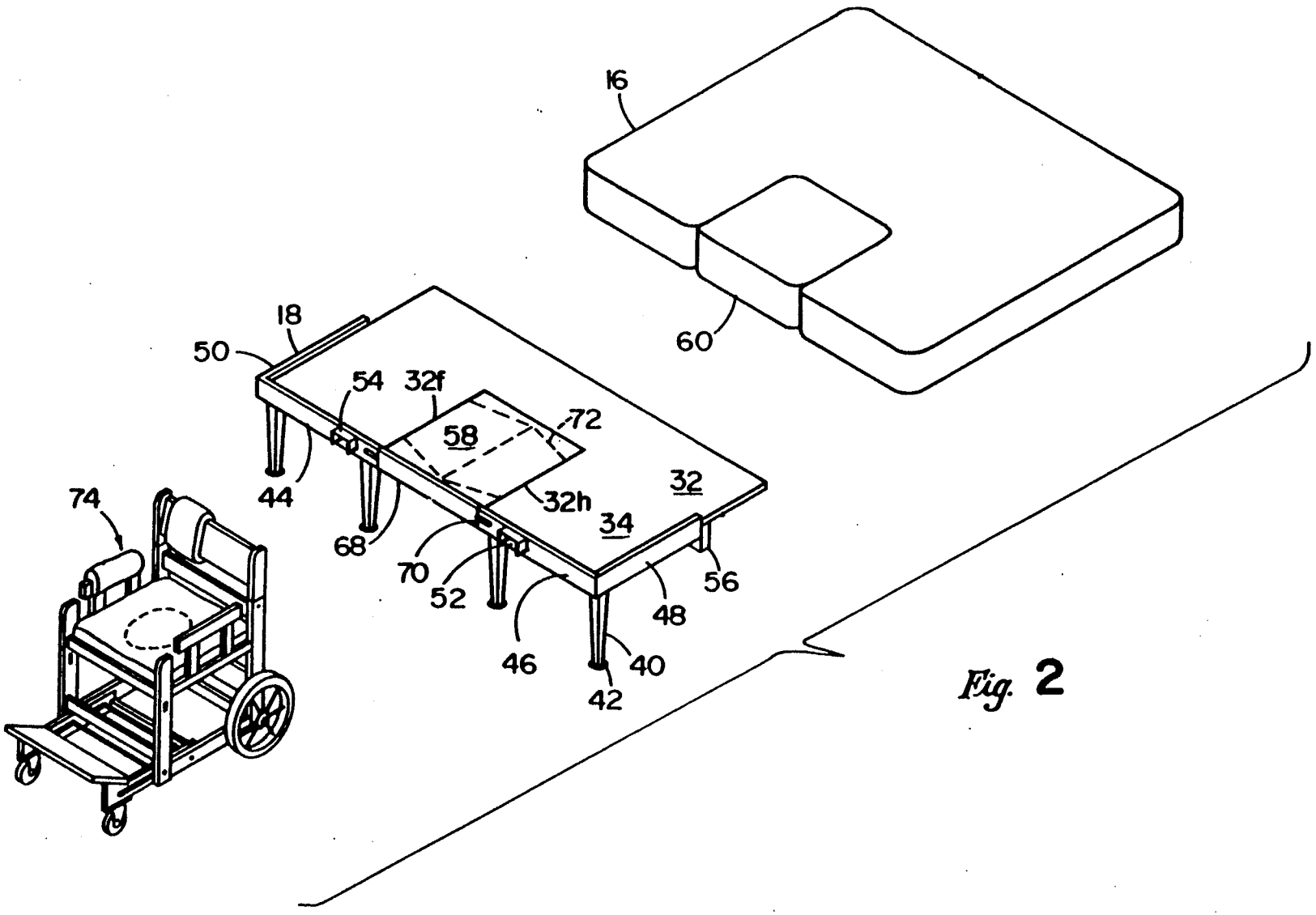
FIG. 2 is an isometric view of individual components of the invention partially assembled including a mattress, an extension insert cushion mounted in the mattress, an extension frame, an insert mounted in the extension frame, and a wheeled carriage.
Figure 3:
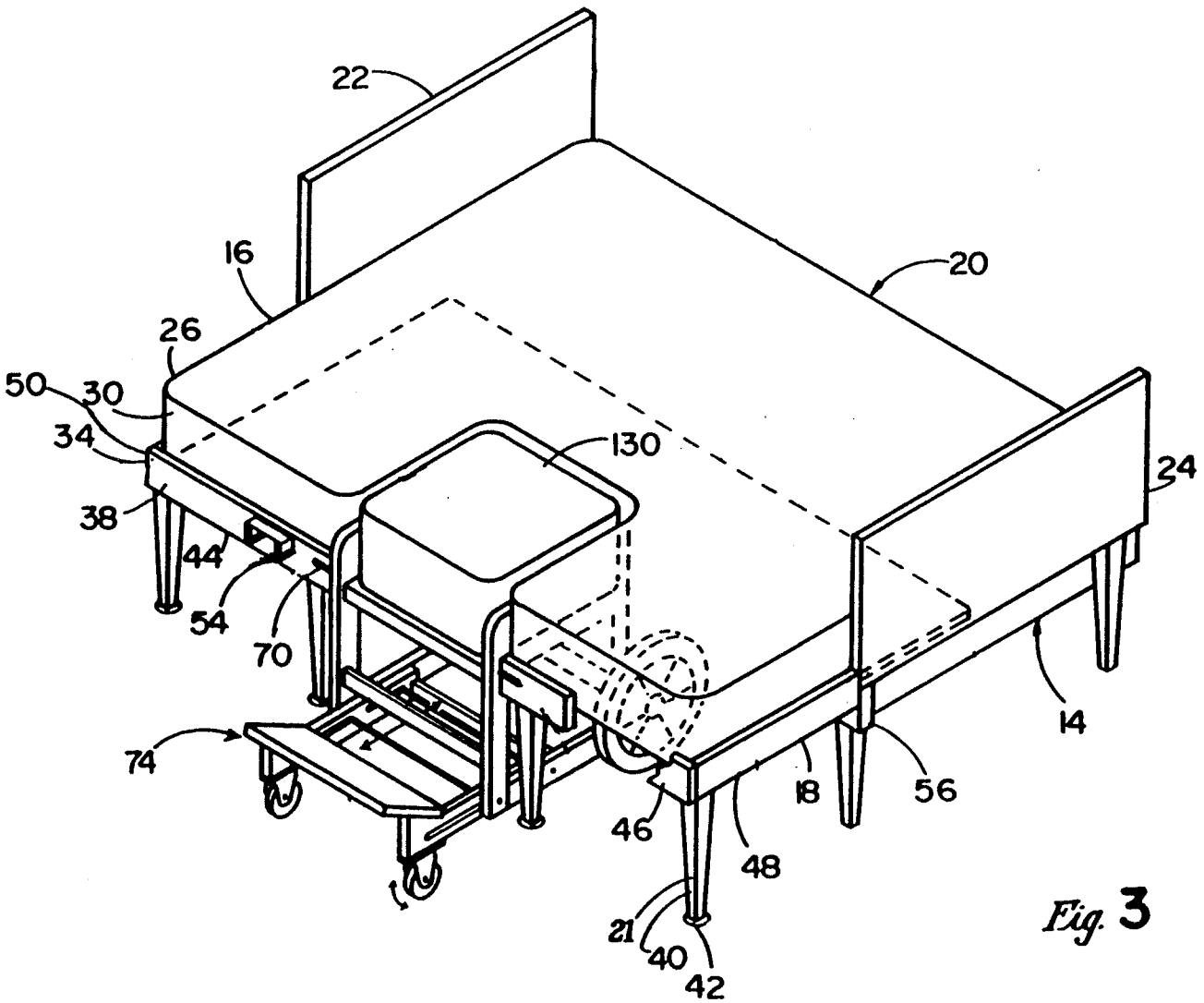

In the preferred embodiment, extension assembly 12 includes extension platform 18 with legs 40 (FIG. 2). Platform 18 includes an inside portion 32 which rests on a box spring positioned on frame 14 of an existing bed (FIG. 1), thereby operably connecting extension platform 18 to bed frame 14. As used herein, the term "bed frame" is intended to include the supporting frame per se as well as any box spring positioned thereon.

A specially designed enlarged mattress 16 covers existing bed frame 14 and adjacent extension frame 18 (FIGS. 1 and 2). Extension frame 18 and mattress 16 both include mating cutaways which open to the outside edge of extension frame 18, away from bed frame 14, to facilitate patient ingress to and egress from the bed and to facilitate patient care. Cutaway 36 in frame 18 can be filled with an extension insert 58 (which can double as a tray) and an insert cushion 60 so that a patient can lie over extension platform 18. Wheeled carriage 74, having removable arms 80*a* and *b* and back 82, can be positioned in cutaway 36 to facilitate patient ingress to and egress from the bed.

Extension platform 18 (FIG. 2) is divided into inside portion 32 and extension portion 34 by a reinforcing and positioning support 56 for positioning adjacent the side edge of an existing bed frame 14. In its installed position, inside portion 32 of platform 18 rests on existing bed frame 14. Positioning support 56 is removably mounted to the underside of platform 18 such that it can be relocated along the width of platform 18 depending on the size of the existing bed frame that the extension platform 18 must mate with. The positioning support 56 permits adjustment, increasing or decreasing the width of inside portion 32 of extension platform 18 which rests on existing bed frame 14. Support 56 not only reinforces platform 18, it also positively locates platform 18 by abutting the existing bed frame 14 and preventing a user from pushing extension platform 18 further back onto frame 14 during the process of locating wheeled carriage 74 in cutaway 36.

Platform 18 is partially framed by end fascia 48 which generally aligns with the foot of bed frame 14 and a opposite end fascia 50 which aligns with the head of bed frame 14. The outside edge of platform 18, which is oriented away from bed frame 14, is framed by outside edge fascia 44 and 46. Legs 40 extend downwardly from platform 18 adjacent outside edge fascia 44 and 46 to engage the floor.

Extension portion 34 of platform 18 is substantially rectangular but has a cutaway 36 located approximately midway between end fascia 48 and 50. Cutaway 36 opens along the outside edge of frame 18, between outside edge fascia 44 and 46. Cutaway 36 is wide and deep enough so that a nurse or patient helper may access extension assembly 12 through cutaway 36 for patient care and is also configured to mate with wheeled carriage 74. Cutaway 36 is bounded on each side by insert supports 32F and 32H which extend from outside edge fascia 44 and 46 to a point approximately aligned with the back edge 32G of cutaway 36. End fascia 48 and 50 and outside edge fascia 44 and 46 extend above the level of platform 18 to aid in mattress location. Handles 52 and 54 are mounted to fascia 44 and 46 respectively to facilitate handling.

Four legs 40 are shown, one leg 40 to support each outside corner of platform 18 and one leg 40 located adjacent each outside corner of cutaway 36. Each leg contains a leveling means such as leveling foot 42 which provides for vertical adjustment of extension platform 18.

Mattress 16 is specially designed to cover an existing bed frame 14 and extension platform 18. It has a main body portion 20 and an extension portion 26. Mattress portion 20 sets between head board 22 and foot 24 of bed frame 14, and covers bed frame 14. Mattress extension portion 26 is shaped similarly to the extension portion 34 of extension platform 18 and has a cutaway 28 which mates with cutaway 36 in frame 18. Thus, mattress 16 is fully supported by and rests on a mattress supporting surface comprised of bed frame 14 and extension platform 18.

Extension insert 58 and extension insert cushion 60, also shown in FIG. 1, fill extension cutaway 36 and mattress cutaway 28 so that a uniform upper mattress surface is formed. Extension insert 58 is supported by insert support ledges 62, 64 and 66 on each edge of cutaway 36 in extension frame 18. Extension insert 58 has a front fascia board 68 which helps to hold mattress insert cushion 60 in place. A pair of latch assemblies 70 are located adjacent to extension cutaway 36 on the front surface of outside edge fascia 44 and 46 and engage front fascia board 68 preventing accidental forward movement of extension insert 58. It is intended that latch assemblies 70 represent and reasonably can be replaced by other substantially equivalent fastening means such as hook and loops, snaps, dead bolts, and the like. As shown, extension insert cushion 60 sets in place on extension insert 58 and is received within mattress cutaway 28 to form a substantially flat upper mattress surface.

Extension insert 58 is fitted with foldable leg supports 72 (FIG. 5). Foldable legs 72 can be opened slightly greater than 90 to provide a small table which can safely straddle cutaway 36. With foldable legs 72 extended, extension insert 58 can be used as a T.V. tray or eating tray by the patient while either lying down in bed or sitting up in the cutaway 36 (with the tray straddling the cutaway).

Wheeled carriage 74, which mateably engages extension cutaway 36 and which can be used instead of insert 58, comprises a box-like frame 76, foot rest 84, arms 80A and B, and back 82 (FIGS. 2-5). Box-like frame 76 comprises two front vertical members 86A and 86B, vertical member 86A and 86B, two rear vertical members 86C and 86D, and multiple horizontal members 90A, 90B, 90C, 90D, 90E, 90F, 90G, 90H and 90J which join vertical members 86A-D and complete the box-like frame. Frame 76 further includes four corner gussets 122 and four horizontal seat support ledges 124 located around the inside upper perimeter of frame *7b* which provide vertical support for the seat 78 and stabilize the frame. Latch holes 88A and 88B are located in front vertical members 86A and 86B, and are positioned to cooperate with latch assemblies 70 located on frame support members 44 and 46 to lock carriage 74 in position in cutaway 36.

Wheels 148 are mounted to the lower rear corners of frame 76. Wheels 148 are smaller in diameter than wheels on a conventional wheeled carriage so that they do not interfere with platform 18 when wheeled carriage 74 is rolled into position in cutaway 36.

Wheeled carriage 74 can alternatively be fitted with removable commode seat frame 78 and removable transport cushion 128, or with insert cushion 60. Commode seat frame 78 comprises a generally square structure which is mateably received within the top of frame 76 and rests on corner supports 122 and horizontal ledges 124. Centered on commode seat frame 78 is commode seat 120. Located on the underside of commode seat frame 78 is catch basin track 125 which is properly positioned to allow catch basin 126 to slide into place. Thus, wheeled carriage 74 can also double as a commode.

A removable transport cushion 128, which affords wheeled carriage 74 with a comfortable but firm ride, can be placed on top of commode seat frame 78. Transport 128 is positioned atop commode seat frame 78, and when wheeled carriage 74 is positioned within cutaway 36, the upper surface of transport seat 12 is generally flush with the surface of specially designed mattress 16. This makes it possible for one to roll wheeled carriage 74 into cutaway 36, remove arms 80A and 80B and back 82, swing ones legs up onto mattress 16, with or without assistance, and lay back on mattress 16. Wheeled carriage 74 thus becomes part of the bed. Wheeled carriage 74, seat frame 78 and transport cushion 128 thus replace platform insert 58 and insert cushion 60 as part of the overall bed assembly. Foot rest 84 can be pushed to its retracted condition so that it does not project from the side of the bed. If the patient has to use the commode, transport cushion 128 can be removed from atop commode seat frame 78 and the patient can swing onto commode seat 120 in the same manner that he or she swings onto transport cushion 128 when it is in place.

In the alternative, commode seat frame 78 and transport cushion 128 ca be replaced by mattress insert cushion 60. When cushion 60 is positioned o corner supports 122 and horizontal ledges 124, and when wheeled carriage 74 is in position in cutaway 36, the top of insert cushion 60 is generally flush with rest of the mattress 16. A patient who does not need a commode and/or a firm seat such as transport seat 128 may prefer this arrangement for seating and sleeping.

As shown in FIG. 4, arm rests 80 contain downwardly extending mounting posts 83 that mateably engage holes 92A and 92B in horizontal member 90A. Mounting posts 83 further contain holes 96 which align with holes 100 in horizontal member 90A and allow locator pin 98 to secure arm rests 80 in place. Back rest 82 similarly has mounting posts 106 that mateably engage holes 108 in vertical members 86C and 86D. Mounting posts 106 similarly contain holes 114 which align with holes 10 and allow locator pin 110 to secure back rest 82 in place. Padding material 102 and 116 can be added to arm rests 80 and back rest 82 respectively for increased user comfort and aesthetic appeal.

Foot rest 84 is comprised of horizontal side members 134A and 134B, rear member 139, and foot rest platform 146. Slots 136A and 136B and 138A and 138B allow foot rest 84 to adjust forwardly and rearwardly by allowing rods 140 and 142 in frame 76 to slide fore/aft in slots 136 and 138. Rear slot 138A and 138B also provide a notch 141 which allows foot rest 84 to lock into forward position, thus assuring user comfort. Castors 144A and 144B are mounted to the front and underside of horizontal side members 134A and 134B, castors 144A and 144B allowing wheeled carriage 74 to be wheeled about with ease. It should be noted that forward adjustment of foot rest 84 also increases the mechanical stability of wheeled carriage 74.

OPERATION

In operation, extension assembly 12 is mounted to an existing bed frame 14 by placing the extension portion 32 of platform 29 on one side of existing bed frame 14. Extension frame 18 is positioned by pushing extension frame 18 towards frame 14 until positioning support 56 contacts the leading edge of existing bed frame 14. Mattress 16 is then placed on top of the existing bed frame 14 and extension platform 18, mattress cutaway 28 being suitably located in line with extension cutaway 36. Adjustments in location may be made as required through the use of handles 52 and 54, or as required by gripping outside fascia 44 or 46. When the patient is using the bed, access to assist the patient may be attained by entering cutaway 28 and 36. This places the care giver immediately adjacent the patient without having to relocate the patient immediately adjacent the edge of the bed. This eliminates the trauma of relocation and the fear of the of the patient rolling off the edge of the bed when the care giver turns his or her back for a moment.

Cutaways 28 and 36 can also be filled by inserting extension insert 58 and extension insert cushion 60 so that an enlarged bed with a generally uniform upper surface and generally rectangular exterior shape are formed. This would allow, for example, a husband and wife to sleep together even though one is somewhat incapacitated.

A patient, with or without assistance, can also swing his or her legs into cutaway openings 36 and 28 and sit along the back edge 32G thereof facing towards the opening defined in the outside edge of frame 18 by cutaway 36. Legs 72 on insert 58 can then be folded down and positioned on mattress 16 on either side of cutaway 28 so that insert 58 serves as a meal tray.

Wheeled carriage 74 can also be placed in extension cutaway 36 as an alternative to insert 58 and insert cushion 60. Arms 80A and B and back 82 can be removed. With either cushion 60 or the combination of commode seat frame 78 and transport cushion 128 atop supports 122 and ledges 124, the entire bed has a uniform, generally flat upper surface and wheeled carriage 74 is conveniently stored. The patient can easily be properly positioned over wheeled carriage 74, and by simply swinging the patient's legs downwardly over the edge of the bed and assisting the patient to sit upright, the patient becomes positioned in an upright position on wheeled carriage 74. Subsequently, removable arm rests 80 and removable back rest 82 can be attached, and foot rest 84 extended so that the patient is ready to be transported. By simply unlatching latches 70, the patient can then be transported about the house with ease.

A similar technique to the above may be employed to allow the patient to utilize wheeled carriage 74 as a commode by removing transport seat 128 to afford access to catch basin 126.

Thus with the present invention, conventional household furniture can be easily and economically converted into a patient care bed. The invention can be used to convert any size bed to a patient care bed. It can be used to convert a twin bed to a double or queen size bed, keeping loved ones together and minimizing separation. Yet the conversion does not make the bed look like a hospital bed. The present invention affords a patient bed which still retains the appearance of conventional home furniture.

The present invention allows the patient to be moved from wheeled carriage 74 to bed without lifting assistance. It provides the patient with access to and use of a commode without lifting assistance. This helps one maintain one's personal dignity. Even if the patient does not need wheeled carriage 74; the system if used with platform insert 58 and insert cushion 60 provides easy access to a care giver for changing dressings, bathing and personal hygiene necessities. The care giver can access the patient without having to relocate the patient closely adjacent to the edge of the bed. The platform insert 58 gives further versatility to the system by doubling as a tray.

Should the patient regain mobility, this system can still be used as a standard bed, thus avoiding the loss of the original investment in the equipment. The system can be purchased in different configurations depending on personal need. For example, the system could be initially purchased without the wheeled carriage. The wheeled carriage could always be added later if needed. The present invention can be purchased as an add on for an existing bed, or can be purchased as a total system, including a conventional bed frame and box springs to which the present invention are added.

Having described my invention, it should be understood that although a preferred embodiment has been disclosed herein, other modifications and embodiments can be utilized without departing from the spirit of this invention. Therefore, this invention should not be limited to only the embodiments illustrated, which have been described by example only.

The embodiments of the invention in which an exclusive property or privilege is claimed are defined as follows:

1. An extension assembly for converting a bed having a frame into a patient care bed comprising:

an extension platform of sufficient strength to support a person's weight having spaced ends, an inside edge, and an outside edge;

means for operably connecting said extension platform to an existing bed frame such that said platform extends the width of the existing bed;

a plurality of spaced supporting legs disposed on said extension platform for supporting said extension platform;

a first cutaway in said extension platform defining a barrier free opening in said platform which extends away from and includes said outside edge of said extension platform to facilitate access to a patient in said bed and to facilitate patient ingress to and egress from said bed; and a mattress extending over said extension platform and including an outside edge generally aligned with said outside edge of said extension platform, said mattress having a second cutaway in substantial alignment with said first cutaway in said extension platform, said second cutaway defining a barrier free opening in said mattress which extends away from and includes said outside edge of said mattress.

2. The extension assembly of claim 1 in which said means for operably connecting said platform to an existing bed frame comprises said platform including an inside platform portion terminating at said inside edge of said platform for resting on an existing bed frame.

3. The extension assembly of claim 2 in which said extension platform includes positioning means on the underside of said platform which defines the outer boundary of said inside platform portion and which serves to position said platform relative to an existing bed by abutting the existing bed frame.

4. The extension assembly of claim 2 wherein said spaced supporting legs include vertical adjustment means.

5. The extension assembly of claim 2 including:

an insert removably positioned in said first cutaway; and an insert cushion removably positioned on said insert second cutaway to form a flush top surface with said mattress.

6. The extension assembly of claim 1 including:

an insert removably positioned in said first cutaway; and an insert cushion removably positioned on said insert in said second cutaway to form a flush top surface with said mattress.

7. An extension assembly for converting a bed having a frame into a patient care bed comprising:

an extension platform of sufficient strength to support a person's weight having spaced ends, an inside edge, and an outside edge;

means for operably connecting said extension platform to an existing bed frame such that said platform extends the width of the existing bed;

a plurality of spaced supporting legs disposed on said extension platform for supporting said extension platform;

a first cutaway in said extension platform opening in said outside edge of said platform to facilitate access to a patient in said bed and to facilitate patient ingress to and egress from said bed;

a mattress extending over said extension platform and having a second cutaway in substantial alignment with said first cutaway in said extension frame;

said means for operably connecting said platform to an existing bed frame comprising said platform including an inside platform portion terminating at said inside edge of said platform for resting on an existing bed frame;

said extension platform including positioning means on the underside of said platform which defines the outer boundary of said inside portion of said platform and which serves to position said platform relative to an existing bed by abutting the existing bed frame; and said positioning means being removably secured to said underside of said platform such that the width of said inside platform portion can be widened or narrowed.

8. An extension assembly for converting a bed having a frame into a patient care bed comprising:

an extension platform of sufficient strength to support a person's weight having spaced ends, an inside edge, and an outside edge;

means for operably connecting said extension platform to an existing bed frame such that said platform extends the width of the existing bed;

a plurality of spaced supporting legs disposed on said extension platform for supporting said extension platform;

a first cutaway in said extension platform opening in said outside edge of said platform to facilitate access to a patient in said bed and to facilitate patient ingress to and egress from said bed;

a mattress extending over said extension platform and having a second cutaway in substantial alignment with said first cutaway in said extension frame;

said means for operably connecting said platform to an existing bed frame comprising said platform including an inside portion terminating at said inside edge of said platform for resting on an existing bed frame; and said mattress being suitably shaped to cover both an existing bed and said extension platform.

9. An extension assembly for converting a bed having a frame into a patient care bed comprising:

an extension platform of sufficient strength to support a person's weight having spaced ends, an inside edge, and an outside edge;

means for operably connecting said extension platform to an existing bed frame such that said platform extends the width of the existing bed;

a plurality of spaced supporting legs disposed on said extension platform for supporting said extension platform;

a first cutaway in said extension platform opening in said outside edge of said platform to facilitate access to a patient in said bed and to facilitate patient ingress to and egress from said bed;

a mattress extending over said extension platform and having a second cutaway in substantial alignment with said first cutaway in said extension frame;

said means for operably connecting said platform to an existing bed frame comprising said platform including an inside portion terminating at said inside edge of said platform for resting on an existing bed frame; and a wheeled carriage and cushion removably located on top of and supported by said wheeled carriage and removably positioned in said first cutaway in said extension platform and in said second cutaway in said mattress respectively, said cushion cooperating with said wheeled carriage to form a flush top surface with said mattress.

10. The extension assembly of claim 9 wherein said wheeled carriage has:

a supporting frame;

a removable back rest on said supporting frame;

removable arm rests on said supporting frame whereby said back rest and said arm rests can be positioned on said frame when a patient is to be transported and removed from said frame when said chair is located in said first cutaway such that said arm rests and said back rest do not interrupt the generally flat top surface defined by said mattress and said cushion.

11. The extension assembly of claim 10 wherein:

said wheeled carriage includes an adjustable foot rest positioned on said supporting frame for movement between a first extended position such that a patient can easily rest his or her feet on it and a second stored position generally within said supporting frame whereby said foot rest does not project from underneath said extension assembly when said wheeled carriage is located in said cutaway.

12. The extension assembly of claim 11 in which said wheeled carriage includes wheels which are sufficiently narrow in diameter that they do not interfere with said platform when said wheeled carriage is rolled into position within said cutaway.

13. The extension assembly of claim 12 in which said wheels of said wheeled carriage include two castors located on said adjustable foot rest, whereby when said adjustable foot rest is extended into its said first extended position, said wheeled carriage has greater stability.

14. The extension assembly of claim 9 including:

said wheeled carriage includes a commode with a removable receptacle located below said seat cushion.

15. An extension assembly for converting a bed having a frame into a patient care bed comprising:

an extension platform of sufficient strength to support a person's weight having spaced ends, an inside edge, and an outside edge, means for operably connecting said extension platform to an existing bed frame such that said platform extends the width of the existing bed;

a plurality of spaced supporting legs disposed on said extension platform for supporting said extension platform;

a first cutaway in said extension platform opening in said outside edge of said platform to facilitate access to a patient in said bed and to facilitate patient ingress to and egress from said bed;

a mattress extending over said extension platform and having a second cutaway in substantial alignment with said first cutaway in said extension frame;

said means for operably connecting said platform to an existing bed frame comprising said platform including an inside portion terminating at said inside edge of said platform for resting on an existing bed frame;

an insert removably positioned in said first cutaway;

an insert cushion removably positioned on said insert second cutaway to form a flush top surface with said mattress; and said insert including foldable legs which are foldable between a stored position beneath said insert and an operating position extending downwardly and slightly outwardly from said insert such that said legs can rest on said mattress on either side of said first and second cutaways to support said insert over said first and second cutaways such that said insert serves as a patient tray.

16. An extension assembly for converting a bed having a frame into a patient care bed comprising:

an extension platform of sufficient strength to support a person's weight having spaced ends, an inside edge, and an outside edge;

means for operably connecting said extension platform to an existing bed frame such that said platform extends the width of the existing bed;

a plurality of spaced supporting legs disposed on said extension platform for supporting said extension platform;

a first cutaway in said extension platform opening in said outside edge of said platform to facilitate access to a patient in said bed and to facilitate patient ingress to and egress from said bed;

a mattress extending over said extension platform and having a second cutaway in substantial alignment with said first cutaway in said extension frame; and said mattress being suitably shaped to cover both an existing bed and said extension platform.

17. An extension assembly for converting a bed having a frame into a patient care bed comprising:

an extension platform of sufficient strength to support a person's weight having spaced ends, an inside edge, and an outside edge;

means for operably connecting said extension platform to an existing bed frame such that said platform extends the width of the existing bed;

a plurality of spaced supporting legs disposed on said extension platform for supporting said extension platform;

a first cutaway in said extension platform opening in said outside edge of said platform to facilitate access to a patient in said bed and to facilitate patient ingress to and egress from said bed;

a mattress extending over said extension platform and having a second cutaway in substantial alignment with said first cutaway in said extension frame; and a wheeled carriage and cushion removably located on top of and supported by said wheeled carriage and removably positioned in said first cutaway in said extension platform and in siad second cutaway in said mattress respectively, said cushion cooperating with said wheeled carriage to form a flush top surface with said mattress.

18. The extension assembly of claim 17 wherein said wheeled carriage has:

a supporting frame;

a removable back rest on said supporting frame;

removable arm rests on said supporting frame whereby said back rest and said arm rests can be positioned on said frame when a patient is to be transported and removed from said frame when said chair is located in said first cutaway such that said arm rests and said back rest do not interrupt the generally flat top surface defined by said mattress and said cushion.

19. The extension assembly of claim 18 wherein:

said wheeled carriage includes an adjustable foot rest positioned on said support frame for movement between a first extended position such that a patient can easily rest his or her feet on it and a second stored position generally within said supporting frame whereby said foot rest does not project from underneath said extension assembly when said wheeled carriage is located in said cutaway.

20. The extension assembly of claim 19 including:

said wheeled carriage includes a commode with a removable receptacle located below said seat cushion.

21. An extension assembly for converting a bed having a frame into a patient care bed comprising:

an extension platform of sufficient strength to support a person's weight having spaced ends, an inside edge, and an outside edge;

means for operably connecting said extension platform to an existing bed frame such that said platform extends the width of the existing bed;

a plurality of spaced supporting legs disposed on said extension platform for supporting said extension platform;

a first cutaway in said extension platform opening in said outside edge of said platform to facilitate access to a patient in said bed and to facilitate patient ingress to and egress from said bed;

a mattress extending over said extension platform and having a second cutaway in substantial alignment with said first cutaway in said extension frame; and an insert removably positioned in said first cutaway;

an insert cushion removably positioned on said insert in said second cutaway to form a flush top surface with said mattress; and said insert including foldable legs which are foldable between a stored position beneath said insert and an operating position extending downwardly and slightly outwardly from said insert such that said legs can rest on said mattress on either side of said first and second cutaways to support said insert over said first and second cutaways.

* * * * *